United States Patent [19]

Kanai

[11] Patent Number: 4,677,817

[45] Date of Patent: Jul. 7, 1987

[54] TRAVELLERS FOR SPINNING MACHINERY

[75] Inventor: Hiroyuki Kanai, Ashiya, Japan

[73] Assignee: Kanai Juyo Kogyo Kabushiki Kaisha, Itami, Japan

[21] Appl. No.: 810,711

[22] Filed: Dec. 19, 1985

[51] Int. Cl.[4] ..... D01H 7/60

[52] U.S. Cl. ..... 57/125; 57/119; 57/120

[58] Field of Search ..... 57/119, 120, 125, 126

[56] References Cited

U.S. PATENT DOCUMENTS

| | | | |
|---|---|---|---|
| 2,572,140 | 10/1951 | Haley | 57/125 |
| 2,683,346 | 7/1954 | Pieper | 57/125 |
| 2,798,357 | 7/1957 | Stahli | 57/119 |
| 3,226,924 | 1/1966 | Dalpiaz | 57/125 |
| 4,079,579 | 3/1978 | Cory | 57/125 |

FOREIGN PATENT DOCUMENTS

| | | | |
|---|---|---|---|
| 2207478 | 9/1972 | Fed. Rep. of Germany | 57/125 |
| 60-2720 | 1/1985 | Japan | 57/119 |
| 1016425 | 1/1966 | United Kingdom | 57/125 |
| 1075178 | 7/1967 | United Kingdom | 57/125 |

*Primary Examiner*—John Petrakes

*Attorney, Agent, or Firm*—Wenderoth, Lind & Ponack

[57] ABSTRACT

A traveller for spinning made of hard drawn steel wire or alloy steel wire, having at least at the surface of a part which makes contact with a ring a ceramic coated layer. The ceramic coated layer consists of one or plural layers selected from a layer of carbide, nitride, oxide, boride or the like. The traveller with a ceramic coated layer was high wear resistance, runs stably for many hours, prevents frequent yarn breakage and has longer service life.

5 Claims, 9 Drawing Figures

TRAVELLERS FOR SPINNING MACHINERY

BACKGROUND OF THE INVENTION

1. Field of the Invention

This invention relates to a traveller for spinning machinery which displays a superior function in high speed ring spinning.

2. Description of the Prior Art

Conventional travellers are usually made of a hard drawn steel wire rod or alloy steel wire rod and some of them are subjected to a surface hardening treatment (quenching) and nickel plating. However, under the present severe operating conditions in spinning mills, conventional travellers for spinning are not satisfactory in wear resistance and have such demerits as early abrasion, unstable running of the traveller, frequent yarn breakage, more yarn fuzzing, earlier "burning" and "fly" of the traveller, etc.

From the above demerits of the conventional traveller, a chrome plated traveller has been suggested. Although the chrome plated traveller has high hardness, it has poor affinity for the ring and causes a very high spinning tension even at the initial stage of spinning, with the result of frequent yarn breakage. Moreover, the plated surface is easy to crack and such cracking can cause exfoliation and wear. Especially when the conventional traveller is used at a high speed spinning of more than 20,000 r.p.m., it causes an increase in the frictional resistance of the ring and the traveller and the sudden rise of frictional heat, which render the continuous operation impossible.

An object of the present invention is to eliminate such demerits of the conventional traveller as mentioned above and to provide a traveller for spinning which has high hardness, improved heat resistance and improved corrosion resistance and is applicable to a high speed spinning of more than 20,000 r.p.m.

SUMMARY OF THE INVENTION

A traveller for spinning according to the present invention is made of hard drawn steel wire or alloy steel wire and has a ceramic coated layer at least at the surface which makes contact with a ring.

The ceramic coated layer is composed of a single layer of carbide, nitride, oxide or boride or composed of a composite ceramic coated layer formed by dispersing ceramic grains with Ni alloy, Ni, Cr, Co, etc. as matrix.

Ceramics to be used in the present invention singly or in combination are SiC, TiC, ZrC, WC, HfC, $B_4C$, NbC, C (diamond), etc. as carbide group, TiN, TiCN, TiN, $Si_3N_4$, TaN, AlN, GaN, BN, InN, etc. as a nitride group, $Al_2O_3$, $ZrO_2$, $SiO_2$, $TiO_2$, $In_2O_3$, ZnO, $Cr_2O_3$, SiO, TiO, MgO, BeO, $ThO_2$, etc. as an oxide group and $TiB_2$, $ZrB_2$, $HfB_2$, etc. as a boride group.

The above ceramic coated layer is formed by a CVD method, including chemical vapor deposition, plasma CVD, optical CVD, etc. or by a PVD method, including vacuum plating, spattering, ion plating, ion beam deposition, using ceramics of carbide group, nitride group, oxide group or boride group, or, composed of composite plating by dispersing ceramic grains uniformly as eutectoid substance, with nickel alloy containing nickel and phosphorus (for example, Ni-P alloy, Ni-W-P alloy, Ni-Co-P alloy, Ni, Cr, Co, etc.) as matrix.

BRIEF DESCRIPTION OF THE DRAWINGS

The nature and advantage of the present invention will be understood more clearly from the following description made with reference to the accompanying drawings, in which:

FIG. 2 and FIG. 3 show the comparison between the traveller for spinning of Embodiment 1 of the present invention and a conventional traveller, in which FIG. 2 shows a curve of cross section hardness distribution and FIG. 3 shows a curve of the rate of traveller "burning".

FIG. 6 and FIG. 7 show the comparison between the traveller for spinning of Embodiment 2 and the conventional traveller, in which FIG. 6 shows a curve of cross section hardness distribution and FIG. 7 shows a curve of the rate of traveller "burning";

A description is made below about several embodiments of the present invention.

EMBODIMENT 1

Figure 1:
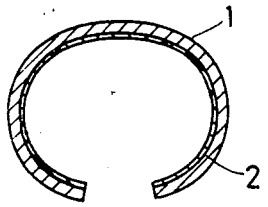
FIG. 1 is a cross sectional view of a horizontal type traveller showing Embodiment 1 of the present invention.

FIG. 1 shows a horizontal type traveller 1 made of hard drawn steel wire rod.

The traveller 1 is subjected to an ion plating treatment by glow discharging at $1-5\times10^{-2}$ Torr in the reactive gas atmosphere with $C_2H_2$ as a main ingredient to form a titanium carbide (TiC) layer of 1–20$\mu$ thickness at the surface which makes contact with a flange of a ring. Then, it is subjected to surface grinding after quenching to form a traveller for spinning of the present invention.

The above titanium carbide coated layer can be applied to the whole surface of a traveller but it is sufficient to apply it only to the surface which makes contact with a ring, for which a masking treatment is given to that surface before coating.

In order to form a layer of carbide, such as TiC, Zrc, NbC, TaC, WC, $B_4C$ or the like, the PVD method such as spattering or the CVD method is sometimes employed. In the case of coating by the PVD method, a heat treatment such as quenching can be given before coating.

Figure 2:
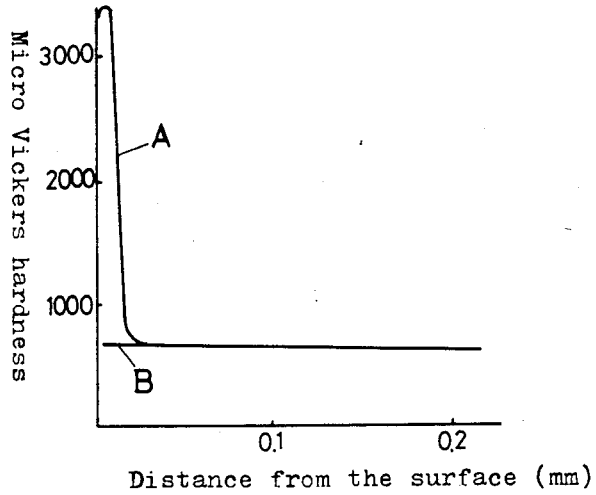

The traveller for spinning according to the present invention is composed as mentioned above and as shown in FIG. 2, the traveller for spinning A according to the present invention has surface hardness of 2,500–3,400 Hv, which is much higher than that of the conventional traveller B for spinning.

Figure 3:
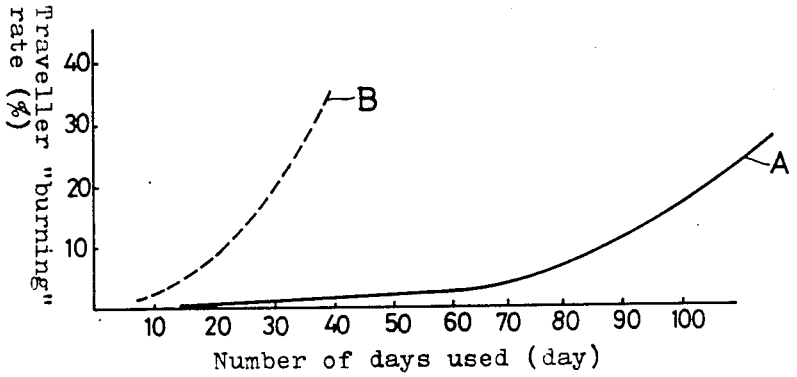
Figure 4:
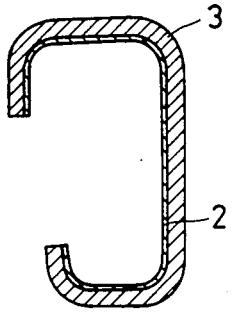
FIG. 4 is a cross sectional view of a vertical type traveller.

FIG. 3 shows the comparison of traveller "burning" rates of the conventional nickel-plated traveller B and the traveller A for spinning according to the present invention, when both were used for spinning under the following testing conditions. From this comparative test, it has been found that the traveller A according to the present invention shows more than 3 times decrease in the traveller "burning" rate.

Inside dia. of ring: 41 mm

Width of flange: 3.2 mm
Fiber: Polyester/cotton 45's
Spindle speed: 20,000 r.p.m
Traveller: YS-2/hf 12/0

The above Embodiment 1 refers to the horizontal type traveller, but it is possible to compose the traveller according to the present invention by forming a titanium carbide layer 2 on a vertical type traveller 3 at least at the surface which makes contact a ring. This vertical type traveller with a carbide layer at the surface is much improved in wear resistance and in affinity to a ring.

EMBODIMENT 2

Figure 5:
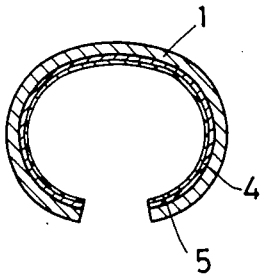
FIG. 5 is a cross sectional view showing Embodiment 2 of the present invention.

A horizontal type traveller 1 of the shape shown by FIG. 5 is made of high carbon chrome steel, tool steel, heat resistant steel or the like.

By subjecting the above traveller to a chemical evaporation at the temperature of 850°–1,050° C. in the gas atmosphere with $TiCl_4$, $H_2$, $Ch_4$, $N_2$ as main ingredients, a composite layer of a titanium carbide (TiC) layer 4 of 1–20μ thickness and a titanium nitride (TiN) layer 5 is formed. Then, the traveller is subjected to surface grinding after quenching. Thus, the traveller for spinning according to the present invention is obtained.

The above titanium carbide layer 4 and the titanium nitride layer 5 can be applied to the whole surface of a traveller but it is sufficient to apply them only to the surface which makes contact with a ring, for which a masking treatment is given to that surface before forming the composite layer.

Figure 6:
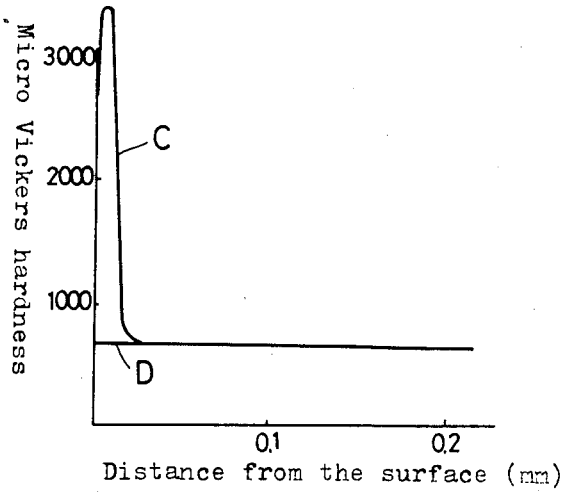

The traveller for spinning according to the present invention is composed as mentioned above. As shown by FIG. 6, the traveller C for spinning according to the present invention has hardness of 1,900–2,500 Hv at the following inner titanium carbide layer. Thus, the traveller C for spinning has much higher hardness than the conventional traveller D for spinning. Since the uppermost titanium nitride layer is slightly lower in hardness than the titanium carbide layer, the traveller C is low in the coefficient of friction and has good affinity to a ring. Moreover, the treated layer and the main body are joined by diffusion and therefore better adhesion than by plating or by physical evaporation can be obtained.

Figure 7:
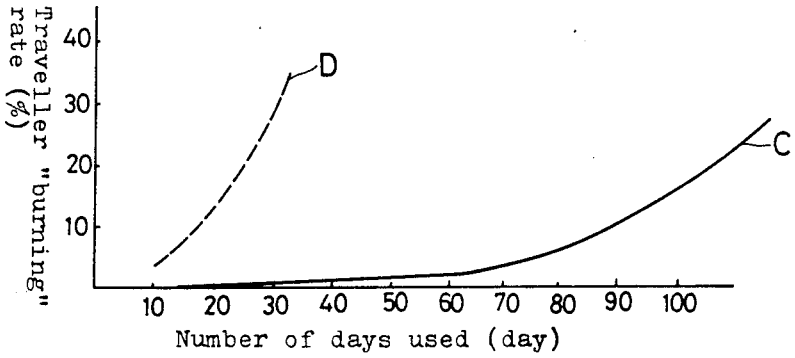

FIG. 7 shows the comparison of traveller "burning" rates of the conventional nickel plated traveller D and the traveller C for spinning according to the present invention, when both were used for spinning under the following testing conditions. From this comparative test, it has been found that the traveller C for spinning according to the present invention shows more than 5 times decrease in the traveller burning rate.

Testing conditions:
Inside dia. of ring: 41 mm
Width of flange: 3.2 mm
Fiber: Rayon Bright 30's
Spindle speed: 20,000 r.p.m.
Traveller: ZSC/hf/8/0

The above ceramic coated layer can be of a plural layer comprising 2–4 layers selected from a carbide layer, a nitride layer, an oxide layer, a boride layer, etc., for example, TiCN+TiN, TiN+TiCN+TiC+TiN, etc., besides the above TiC+TiN.

In the case of a plural ceramic coated layer, better wear resistance, better corrosion resistance and better affinity to a ring can be obtained by making the uppermost layer a nitride layer.

EMBODIMENT 3

Figure 8:
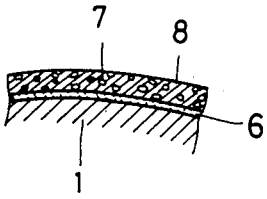
FIG. 8 is a cross sectional view of a main part, partly broken away, of Embodiment 3 of the present invention.

By subjecting a horizontal type traveller 1, made of alloy steel wire rod and imparted with a quenching and tempering treatment, to electronickeling a nickel coated layer 6 of around 1μ thickness as shown in FIG. 8 is formed.

The traveller 1 having the nickel plated layer 6 was soaked in a plating bath of the following compounding ratio controlled to the bath temperature of 90° C. and pH 4.5 and non-electrolytic compound plating was carried out, while adding 2 g/liter of silicon carbide of 0.4μ as ceramic grains, stirring the bath and turning the traveller as in the case of barrel plating.

Figure 9:
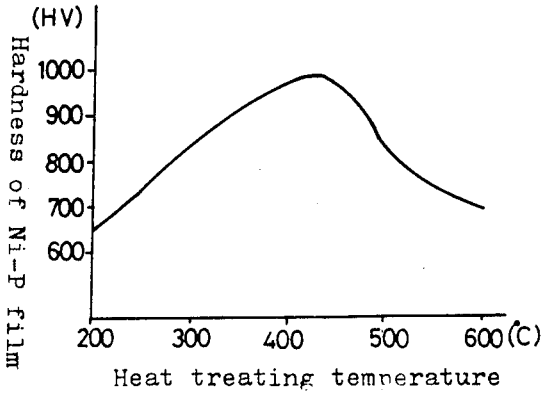
FIG. 9 shows a relation between the heat treating temperature and hardness of Ni-P film.

Nickel sulfate: 24 g/liter
Sodium hypophosphate: 21 g/liter
Lactic acid: 30 g/liter
Propionic acid: 2 mg/liter
Lead nitrate: 0.0001 g/liter By the above treatment, a composite plated layer 8 of 5–20μ thickness in which silicon carbide (SiC) 7 was precipitated in nickel matric on the surface of the nickel plated layer 6 was formed. Then, after the above-mentioned compound plating, the traveller was heated for about one hour at about 400° C. in a heat treating furnace, whereby the electroless plating nickel plated film was imparted with the hardness of 1,000 Hv due to crystallization of nickel-phosphorus, as shown by FIG. 9. The crystallization of nickel-phosphorus strengthened the adhesion of silicon carbide.

It is possible to adjust the amount of dispersion of nickel phosphide ($Ni_3P$) crystallized in an Ni base body by adjusting the content of phosphorus in the above electroless plating nickel-phosphorus alloy film to 4–15% (preferably, 6–12%).

The amount of ceramic grains contained as eutectic substance should be 10–40% in weight (preferably, about 20%) in matrix in the size of 0.2–3μ. The adhesion between the upper composite layer and the surface of traveller is strengthened, due to the existence of the lower nickel plated layer but it is possible to apply a composite plated layer directly to the surface of traveller.

The above composite plated layer is 5–20μ in thickness but if the thickness is less than 5μ, the traveller will show poor wear resistance in high speed spinning and if it is over 20μ, the plated surface will become rough and such roughness can cause cracks. Moreover, thicker plating requires a very long treating time, with the result of an increase in manufacturing cost.

If the size of ceramic grains exceeds 3μ, grains will come off the plated layer earlier and if it is less than 0.2μ, wear resistance will be reduced.

Silundum having high strength, high chemical resistance, high wear resistance and good heat conductivity is the best as ceramic grains contained in a composite plated layer. It has such merit that it radiates easily frictional heat generated by running of a traveller and consequently prolongs the service life of traveller.

In the traveller for spinning of Embodiment 3, a tempering treatment before a plating treatment can be omitted by making a proper choice of a heating treatment after plating.

Since the traveller for spinning according to the present invention is made of hard drawn steel wire or alloy steel wire and has at least at the part which makes contact with a ring a ceramic coated layer of carbide group, nitride group, oxide group, boride group or the like which has good adhesion to the basic material, it is highly resistant to wear, runs stably for many hours, prevents frequent yarn breakage, has longer service life and is smooth in the surface of coated layer. Especially in the case of composite ceramic coated layer, metal such as Ni, Cr, Co, etc. in alloy of nickel group as matrix work effectively when a traveller slides in contact with a ring and such effective working improves affinity of traveller to a ring, makes continuous operation at a high speed of more than 20,000 r.p.m. possible and prevents frequent yarn breakage and yarn fuzzing. Moreover, as the nitride layer contributes to the improvement of corrosion resistance, travellers for spinning according to the present invention are free from corroding even when they are used in spinning of flame-resistant fiber.

What is claimed is:

1. A traveller for spinning made of a hard steel wire or an alloy steel wire body, having a surface coated with a ceramic nitride layer selected from the group consisting of TiN, TiCN, ZrN, $Si_3N_4$, TaN, AlN, GaN, BN and InV, said coating being at least at the surface of a part which makes contact with a ring.

2. A traveller for spinning made of hard steel wire or alloy steel wire body, having a plurality of ceramic coated layers of the same or different kind, each layer being selected from the group consisting of SiC, TiC, ZrC, TiN, TiCN, ZrN, $Al_2O_3$, $ZrO_2$, $SiO_2$, $TiB_2$ or $ZrB_2$ at least at the surface of a part which makes contact with a ring.

3. A traveller for spinning as defined in claim 2, wherein an outermost layer of the plurality of ceramic coated layers is a nitride layer.

4. A traveller for spinning made of hard steel wire or alloy steel wire body, having a composite ceramic coated layer formed by dispersing ceramic grains of $0.2\mu$–$3\mu$ in grain diameter with an alloy of an Ni group, Ni, Cr or CO as matrix at least at the surface of a part which makes contact with a ring.

5. A traveller for spinning as defined in claim 4, wherein the ceramic grains are of at least one kind selected from the group consisting of SiC, TiC, $B_4C$, WC, C, including diamond, TiN, $Si_3N_4$, $Al_2O_3$, $SiO_2$ and $TiB_2$.

* * * * *